US005933899A

United States Patent [19]

Campbell et al.

[11] Patent Number: 5,933,899

[45] Date of Patent: Aug. 10, 1999

[54] LOW PRESSURE AUTOMATIC SWIMMING POOL CLEANER

[75] Inventors: Sanford F. Campbell, Redding; Bret Martin, Cottonwood, both of Calif.

[73] Assignee: Letro Products, Inc., Redding, Calif.

[21] Appl. No.: 09/108,283

[22] Filed: Jul. 1, 1998

Related U.S. Application Data

[63] Continuation-in-part of application No. 08/741,957, Oct. 31, 1996.

[51] Int. Cl.[6] ..... E04H 3/20

[52] U.S. Cl. ..... 15/1.7; 55/374; 180/7.1; 180/7.3

[58] Field of Search ..... 15/1.7; 55/374, 55/376–379; 180/7.1, 7.3

[56] References Cited

U.S. PATENT DOCUMENTS

| | | |
|---|---|---|
| 3,439,368 | 4/1969 | Myers . |
| 3,822,754 | 7/1974 | Henkin et al. . |
| 3,936,899 | 2/1976 | Henkin et al. . |
| 3,972,339 | 8/1976 | Henkin et al. . |
| 4,558,479 | 12/1985 | Greskovics et al. . |
| 4,920,599 | 5/1990 | Rief . |
| 5,001,800 | 3/1991 | Parenti et al. . |
| 5,099,535 | 3/1992 | Chauvier et al. . |
| 5,603,135 | 2/1997 | Jones et al. . |

FOREIGN PATENT DOCUMENTS 464 538 B 10/1970 Australia .

OTHER PUBLICATIONS

Brochure entitled "JetVac America's Best Built Pool Cleaner" copyright 1993, Letro Products, Inc.

JetVac Advertisement, copyright 1993, Letro Products, Inc.

*Primary Examiner*—Jeanette Chapman

*Attorney, Agent, or Firm*—Fliesler, Dubb, Meyer & Lovejoy LLP

[57] ABSTRACT

A pool cleaner operating with a pool cleaning system which is not equipped with a booster pump. The apparatus may comprise a frame having a forward end and a rearward end with a water inlet mounted on the frame and receiving a supply of water having a volume per unit time. The inlet may comprise a supply mast having a number of openings for supplying water to the various components of the cleaner. The frame is carried on a plurality of transport wheels mounted on the frame. The apparatus further includes a vacuum system including a collection bag positioned on a suction mast having water injection ports positioned such that at least one opening in the water injection port injects water into the collection bag to create suction and draw debris into the bag. A drive system is provided to move the apparatus around the pool. The drive system includes a turbine having a plurality of vanes rotating and mounted in a turbine housing. The turbine housing has a first water input and a second water input each oriented to allow a stream of water passing therethrough to impact an individual vane at the same angle of incidence as the vane passes through the stream. A drive axle couples to the turbine and at least one of the plurality of transport wheels. In a further aspect the drive system may include thruster jets positioned on the mast adjacent to the rearward end of the frame.

18 Claims, 7 Drawing Sheets

FIG. 12
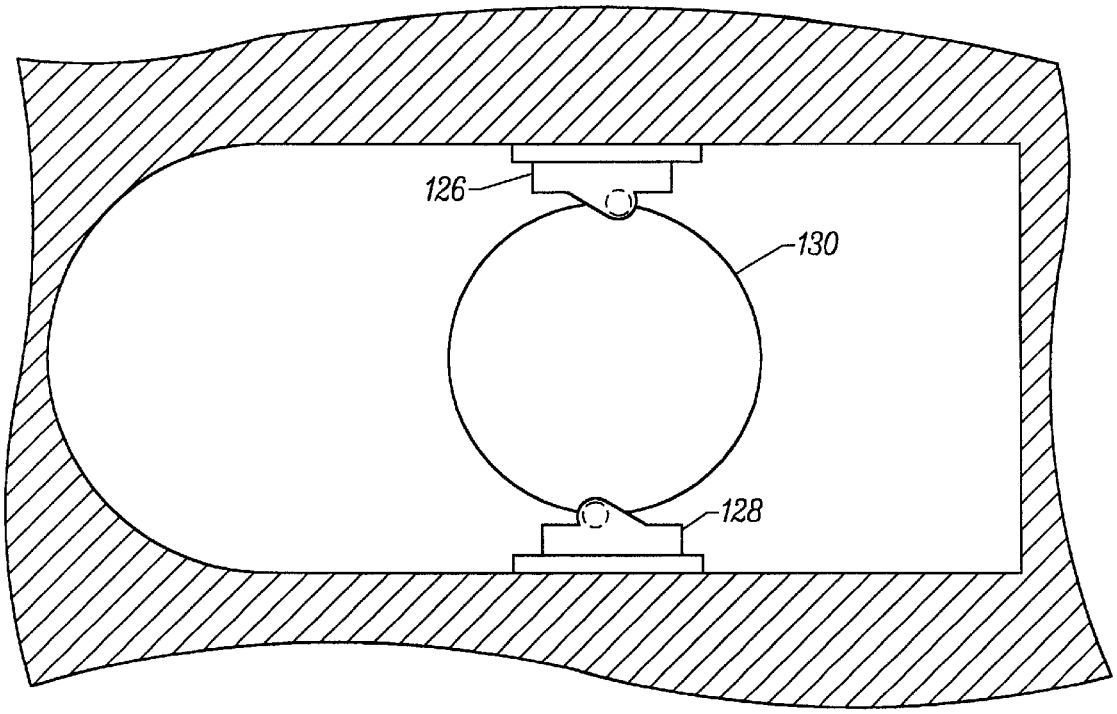
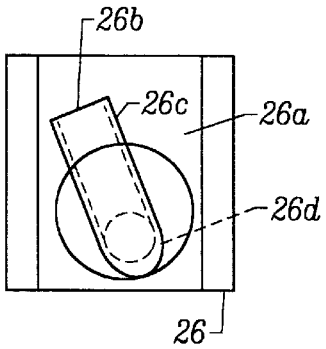
FIG. 13
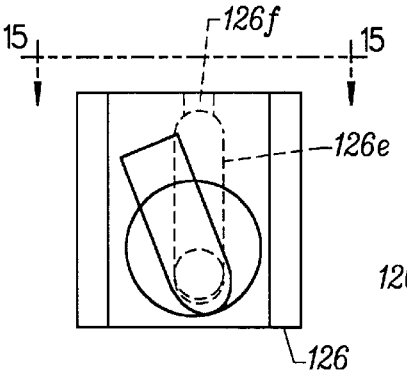
FIG. 14
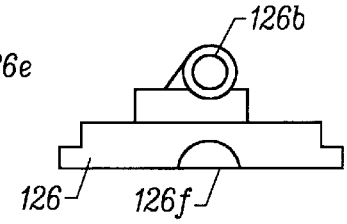
FIG. 15
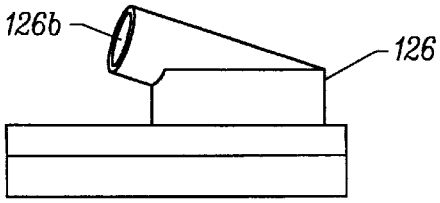
FIG. 16

LOW PRESSURE AUTOMATIC SWIMMING POOL CLEANER

CROSS-REFERENCE TO RELATED APPLICATION

This application is a continuation-in-part of U.S. patent application Ser. No. 08/741,957, entitled AUTOMATIC SWIMMING POOL CLEANER, filed Oct. 31, 1996, incorporated herein by reference.

BACKGROUND OF THE INVENTION

1. Field of the Invention

This invention relates generally to the field of automatic swimming pool cleaners, and more particularly, to cleaners of the type for submerged and generally random travel along the floor and sidewalls of a swimming pool to dislodge and collect debris.

2. Description of the Related Art

A swimming pool normally includes a water filtration system for removing dirt and debris from the pool water. Such filtration systems typically include a circulation pump which is installed outside the swimming pool and a piping system for coupling the circulation pump to the swimming pool. The circulation pump draws water from the swimming pool for delivery through the piping system to a filter unit.

One or more baskets are located in the piping system upstream from the filter unit to catch larger debris, such as leaves and the like; the filter unit functions to separate dirt and fine debris from the water. The water is then re-circulated by the pump back to the swimming pool.

A conventional water filtration system is satisfactory for removing dirt and debris of a relatively small size that is suspended in the water, but it is not designed to remove larger debris. Such systems depend on the aforementioned baskets to prevent larger debris from reaching the filter. However, it is generally advisable to clean out such baskets regularly to avoid the possibility that they may become clogged, blocking the flow of water through the pipes and resulting in damage to the circulation pump. Moreover, a conventional water filtration system is not designed to remove silt and debris which tends to settle irrespective of size onto the floor and sidewalls of a swimming pool.

To address the foregoing problems, automatic swimming pool cleaners for cleaning the floor and sidewalls of a swimming pool are well known.

There are generally four types of pool cleaners in the pool cleaning market: pressure or return side cleaners; suction cleaners; electric cleaners and in-floor cleaners.

Suction side cleaners connect to the pool's skimmer and utilize the sucking action of the water being drawn from the pool by the filter pump to vacuum debris. These cleaners do not sweep, nor to they employ a collection bag, as demonstrated by U.S. Pat. No. 5,001,600 (Parenti, et al.). Instead, large debris vacuumed by the suction side cleaners is deposited in the skimmer or pump basket, while sand and silt that is small enough to pass through the skimmer is captured in the pool's filter.

In-floor cleaners comprise pop-up sprinkler heads built into the floor of the pool and are not generally competitive with pressure, suction or electric sweep cleaners.

Electric cleaners include an electrical motor and attach to an electric cord that extends into the swimming pool. These cleaners operate much like a household vacuum cleaner and may include a filter or collection bag to collect debris.

However, the sweeping action of electric cleaners is limited to a roller or brush positioned under the cleaner and the cleaner does not act as roving return lines for chemically treated or heated pool water. Because they are very costly, they have never been a significant factor in the residential in-ground pool cleaner market.

Generally, "pressure" or return-side cleaners perform superior cleaning over the other three types of cleaners because: Pressure cleaners both vacuum and sweep; Pressure cleaners act as a roving return line to circulate pool chemicals and heated water throughout the pool; Pressure cleaners to not interfere with pool skimmer operation; and Pressure cleaner have a collection bag to avoid the risk of clogging the pool's skimmer or pump basket and filter with debris.

One significant difference in such types of cleaners is the use of a debris bag in the pressure-type cleaners. Pressure-type cleaners use pressurized water from a pump into the cleaner to sweep and collect debris into a bag carried by the cleaner. This means that the bag itself has a weight, buoyancy, and a weight factor that changes when debris collects in the bag. The cleaner must be able to traverse the entire pool without being toppled. Weight is added to the bag when debris is collected in the bag, changing the weight of the bag as the cleaner moves in the pool.

In a pressure cleaner, the influx of water into the cleaner affects the manner in which the cleaner acts under water. The buoyancy of objects is also a significant consideration in developing pressure cleaners and is affected by the component in the cleaner and the water inflow and action of the water within the cleaner. These considerations are not present in electric cleaners or suction cleaners.

Pressurized cleaners can be characterized into at least two categories—those requiring a booster pump and those which do not. Booster pumps are used in conjunction with the pools skimmer pump to provide pressurized water to the cleaner at a rate sufficient to operate the cleaner effectively.

One particular type of known automatic pressure cleaner is shown and described in U.S. Pat. Nos. 3,822,754, 3,936,899, and 4,558,479. This type of cleaner has three wheels positioned in a skewed triangular arrangement on the outside of a housing, with the housing having a front nose set angularly with respect to the direction of cleaner movement. An open and generally vertically oriented suction mast defines a flow path through the housing with a collection bag mounted at the upper end.

This type of cleaner operates on pressurized water that is supplied to the cleaner through a supply hose. The water is used in part to drive the blades of a turbine which, in turn, rotates two or more of the wheels, and in part to induce a flow of pool water upwardly through the suction mast and into the collection bag. A portion of the pressurized water is also supplied through a sweep hose jet to a sweep hose and through a thrust jet, both at the rear of the cleaner. A booster pump may be used to generate added water pressure for the cleaner, because the circulation pump normally used in most swimming pool filtration systems does not create sufficient water pressure for all of the above purposes.

In operation of this type of cleaner, the drive wheels and thrust jet propel the cleaner along the floor and sidewalls of the swimming pool. When the pool cleaner reaches an obstruction preventing further direct forward travel, the skewed drive wheels and angled front nose of the cleaner housing imparts a turning movement, causing the cleaner to turn and continue travel in a different direction. Alternatively, when the cleaner travels along the pool floor and reaches a smoothly curved region merging with a sidewall, the cleaner tends to travel through the curved region and crawl at least part way up the pool sidewall with suction-assisted wheel traction until the cleaner falls by gravity back to the floor of the pool. A ballast float mounted at the upper rear of the cleaner helps assure that the cleaner will land upright on the pool floor and resume travel in a forward direction. As the cleaner travels around the pool, it vacuums the larger debris up through the suction mast into the collection bag. At the same time, the whipping action of the sweep hose sweeps any silt and smaller debris into suspension so that it can be filtered out by the pool's filtration system.

While submerged pool cleaning devices of the foregoing type have performed in a generally satisfactory manner, certain shortcomings have been observed in available commercial equipment. For example, existing cleaners have been constructed on the premise that it is advantageous for all three wheels to be driven by the turbine. In order to accomplish this, however, the cleaner uses a drive train for the wheels which either has been partly exposed to potential jamming or damaged from contact with pool debris, or has used internal belts that have not proved highly reliable. In addition, existing cleaners have not typically been capable in practice of climbing the sidewalls of a swimming pool as aggressively as desired. For example, instead of the cleaner turning when it reaches a relatively sharp transition between the pool floor and a sidewall, it would be desirable for the cleaner to continue its forward travel and climb the sidewall. Further, it would be desirable for the cleaner to climb the sidewall nearly all the way to the waterline.

In addition, cleaners of the type listed in the '479 patent have required a booster pump be installed in order to generate sufficient pressure to the apparatus to power the device about the pool. In older pool installations, the pool's cleaning system may require retrofitting to install the booster pumps in order to properly operate the device.

Accordingly, a need exists for an improved automatic swimming pool cleaner of the type adapted for submerged travel over pool surfaces operating effectively without a booster pump. The present invention fulfills these and other needs.

SUMMARY OF THE INVENTION

Briefly, and in general terms, the present invention resides in a novel and improved design for an automatic swimming pool cleaner of the type for submerged and generally random travel along the floor and sidewalls of a swimming pool to dislodge and collect debris. In particular, the cleaner includes improved wheel and drive train arrangements and other features that result in enhanced climbing ability with a highly reliable drive train having virtually no exposure to potential jamming or damage from debris.

In one aspect, the pool cleaner of the present invention comprises a frame which is carried by a plurality of wheels and on which is mounted a housing with a turbine, water supply means for receiving a supply of water through a supply hose, and a vacuum system comprising a suction mast defining an open flow path from a lower end positioned generally beneath the housing to an upper end disposed generally above the housing, with means for inducing a water flow adjacent the submerged surfaces of the swimming pool for drawing debris from within the pool into a collection bag mounted at the upper end of the suction mast.

Significantly, in accordance with a primary aspect of the present invention, the wheels for the cleaner include first and second wheels which are mounted on opposite sides of the housing for rotation about a common axis. A drive system is provided to couple the turbine to both the first and second wheels for driving rotation to propel the cleaner in a forward direction along the submerged surfaces of the swimming pool. The first and second wheels are sized and positioned such that they extend beyond the forward end of the frame and of the housing. When the first and second wheels engage a relatively sharp transition between the pool floor and a sidewall, the cleaner tends to continue its forward travel and climbs the sidewall, rather than turning and heading off in a different direction along the pool floor.

In a further aspect of the invention, the first and second wheels are mounted forwardly of the suction mast, thereby providing the cleaner with front wheel drive. The turbine may be drivingly coupled to the first and second wheels by means of gears that mesh with wheel gear.

Third and fourth wheels are also mounted on opposite sides of the housing rearwardly of the suction mast. The third and fourth wheels also may be mounted for rotation about a common axis, similar to the first and second wheels.

In a further aspect of the present invention, a forward end of an upper surface of the housing is provided with a sloping portion to impart a downward force at the forward end of the cleaner to reduce its tendency to lift off the submerged surfaces of the swimming pool as the first and second wheels propel the cleaner in the forward direction. The sloping portion of the forward end of the upper surface of the housing comprises at least about one-half of the area of the upper surface extending forwardly of the suction mast and has a linear slope at an angle of about 40 degrees.

In a second embodiment, the improved cleaner operates with a pool cleaning system which is not equipped with a booster pump. In particular, such apparatus may comprise a frame having a forward end and a rear end with a water inlet mounted on the frame and receiving a supply of water having a volume per unit time. The inlet may comprise a supply mast having a number of openings for supplying water to the various components of the cleaner. The frame is carried on a plurality of transport wheels mounted on the frame. The apparatus further includes a vacuum system including a collection bag positioned on a suction mast having water injection ports positioned such that at least one opening in the water injection port injects water toward the collection bag to create suction and draw debris into the bag. A drive system is provided to move the apparatus around the pool. The drive system includes a turbine having a plurality of vanes rotating and mounted in a turbine housing. The turbine housing has a first water input and a second water input each oriented to allow a stream of water passing therethrough to impact an individual vane at the same angle of incidence as the vane passes through each stream. A drive axle couples to the turbine and at least one of the plurality of transport wheels. In a further aspect the drive system may include thruster jets positioned on the mast adjacent to the rear end of the frame.

An automatic swimming pool cleaner in accordance with the present invention has enhanced ability to operate with pool systems not having additional booster pumps. These features and advantages of the present invention should be apparent from the following detailed description of the presently preferred embodiment, taken in conjunction with the accompanying drawings, which illustrate by way of example the principles of the invention.

BRIEF DESCRIPTION OF THE DRAWINGS

The invention will be described with respect to the particular embodiments thereof. Other objects, features, and advantages of the invention will become apparent with reference to the specification and drawings in which:

FIG. 12 is an enlarged bottom view of the opening in lower housing 116 of the automatic pool cleaner illustrated in FIG. 8.

FIG. 13 is an enlarged top view of a water supply jet positioned within the bottom opening of suction mast 130.

FIGS. 14, 15 and 16 are top and end and side views, respectively, of a second embodiment of the water jets of the present invention.

DETAILED DESCRIPTION OF THE PREFERRED EMBODIMENTS

Figure 1:
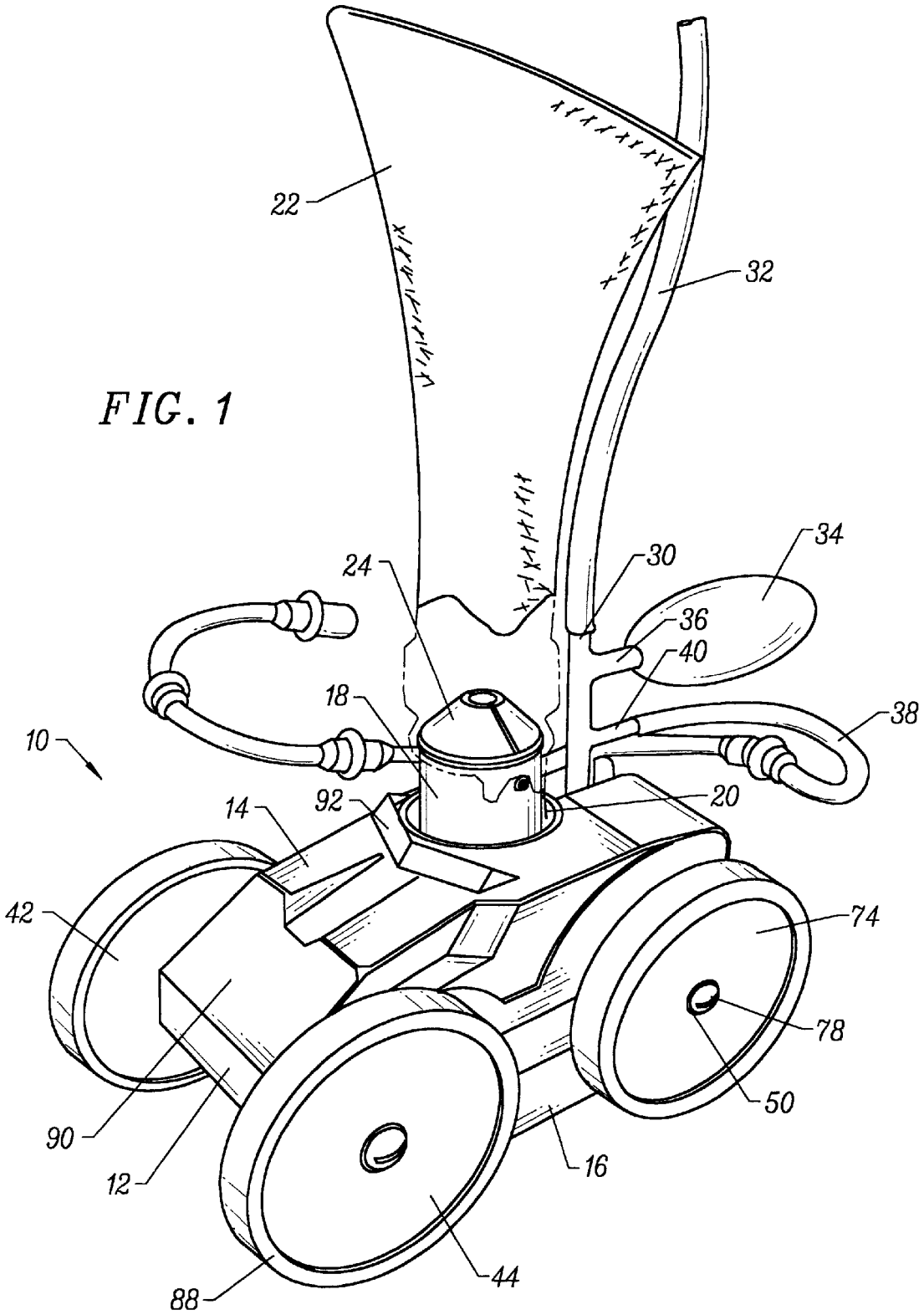
FIG. 1 is a perspective view of a first embodiment of an automatic swimming pool cleaner of the present invention, with a portion of the collection bag shown in phantom for purposes of illustration.
Figure 2:
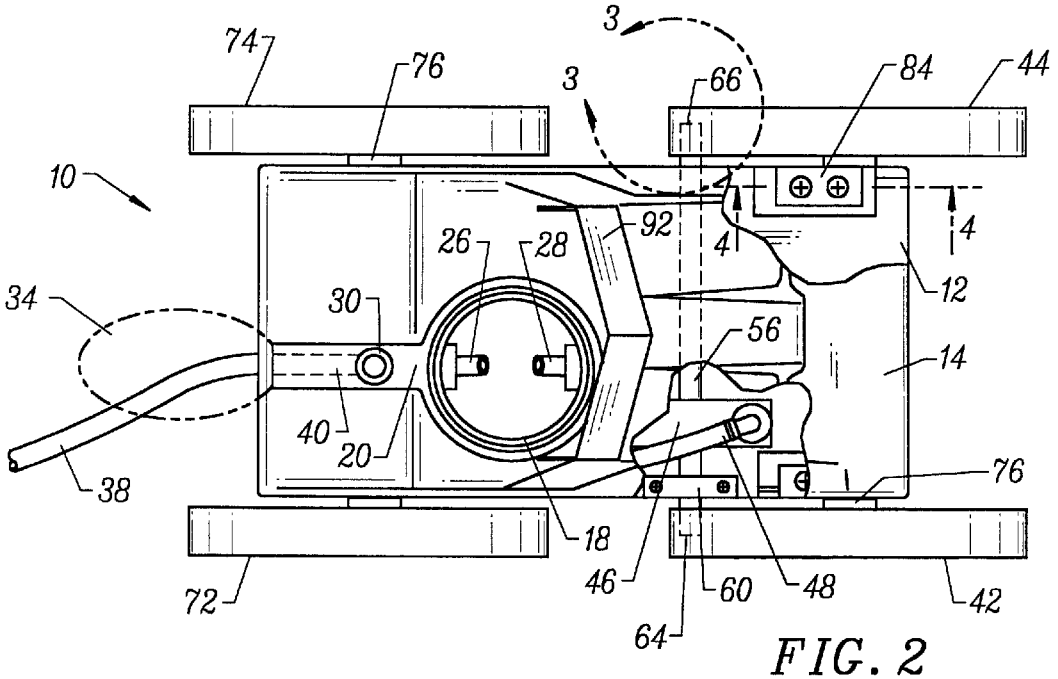
FIG. 2 is top plan view of the automatic swimming pool cleaner shown in FIG. 1, with the collection bag and flapper valve omitted, the float shown in phantom for purposes of illustration, and a forward portion of the upper surface of housing broken away to show both the mount and the drive train for the first and second wheels.

Referring now to the drawings, and particularly to FIGS. 1 and 2 thereof, there is shown by way of example a first embodiment of an automatic swimming pool cleaner 10, incorporating the principles of the present invention. The cleaner 10 includes a frame 12 on which a housing, consisting of an upper housing shell 14 and a lower housing shell 16, is mounted. An open suction mast 18 for vacuuming debris from beneath the cleaner 10 extends through an opening 20, generally in the middle of the upper housing shell 14, and a collection bag 22 is attached to the suction mast, over a flapper valve 24 positioned on the upper end of the suction mast, to collect the debris. A pair of opposing jets 26 and 28 are located inside the suction mast 18 (FIG. 2), near its inlet at the bottom of the cleaner 10, for inducing a flow of water upwardly through the suction mast and into the collection bag 22 in well-known manner. When the cleaner 10 is operating, the force of the water pushes open the flapper valve 24; when the cleaner ceases operating, the flapper valve closes by virtue of gravity to keep the debris in the collection bag 22 from failing back into the swimming pool through the open suction mast 18.

A vertically oriented supply mast 30 extends through the opening 20 in the upper housing shell 14, behind the suction mast 18, to which a supply hose 32 is connected for delivering pressurized water to the cleaner 10. A float 34 is positioned on a support arm 36 formed integrally with, and projecting rearwardly from, the supply mast 30, and a sweep hose 38 is connected to a sweep hose jet 40 that similarly projects rearwardly from the supply mast. In addition, a thrust jet (not shown) is provided at the rear of the cleaner 10. Water from the supply mast is transferred to the thrust port, sweep hose 38, jets 26,28 and, as described below, turbine 46.

In accordance with the invention, a first wheel 42 and a second wheel 44 of equal size are positioned on opposite sides of the cleaner 10, forwardly of the suction mast 18, for rotation on a common axis. A turbine 46 is mounted within the frame 12 for producing rotary motion in response to a pressured water flow supplied thereto via hose 48, which connects to an outlet 50 (FIG. 5) near the base of the supply mast 30, within the cleaner housing. The turbine 46 is conventional in design, having a water inlet port 52, a water wheel 54, a water outlet port (not shown), and a power output shaft 56 which is rotated in response to water being supplied to the inlet port 52.

Figure 3:
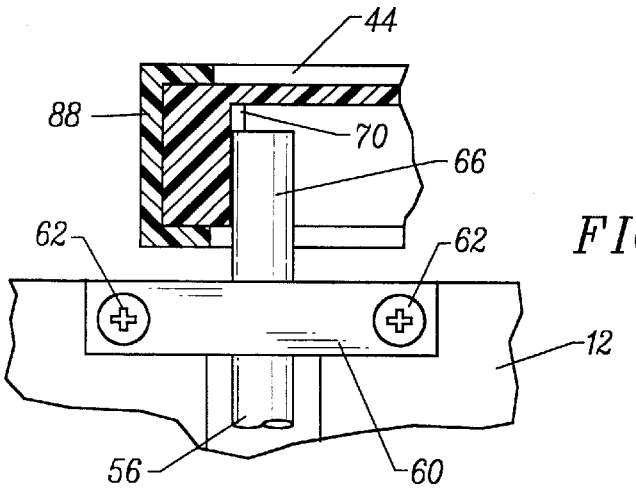
FIG. 3 is an enlarged, fragmentary view, partly in cross-section, of the region indicated by the line 3 in FIG. 2.
Figure 5:
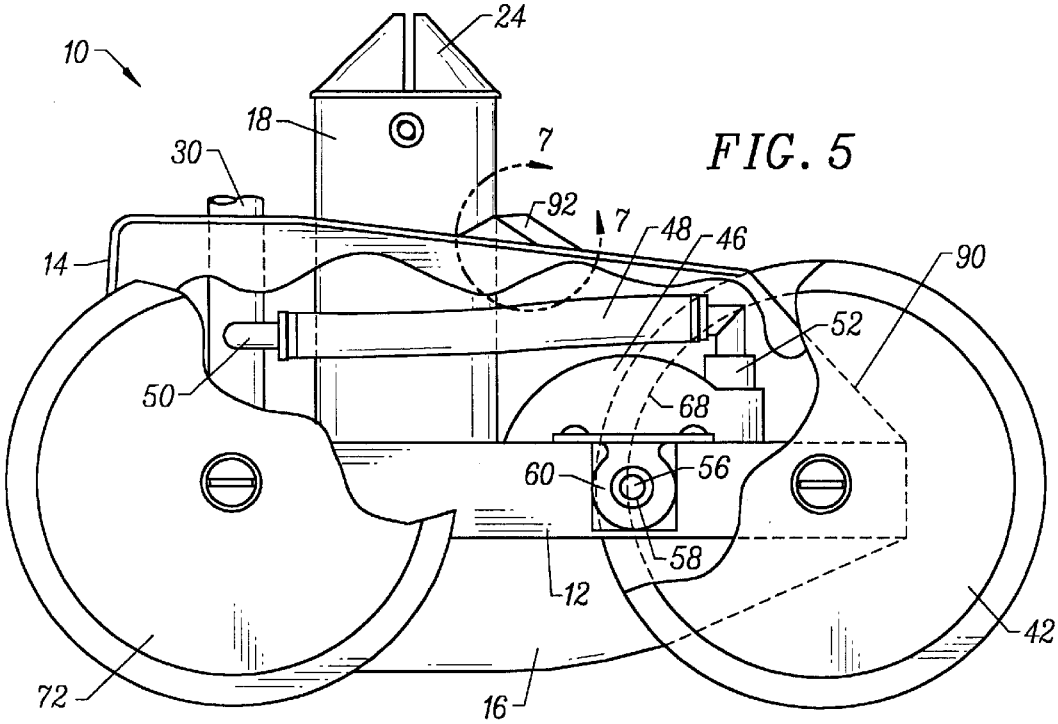
FIG. 5 is a side elevational view, partly broken away, of the automatic swimming pool cleaner shown in FIG. 1, omitting the collection bag, sweep hose, and float.

The power output shaft 56 extends axially in both directions from the turbine 46 and is journaled for rotation by nylon bearings 58 in mounting blocks 60 which are secured by screws 62 in the sidewalls of the frame 12. The opposite ends 64 and 66 of the output shaft 56 have splines formed thereon in the nature of gears. Each splined end 64 and 66 of the output shaft drivingly engages an annular rack 68 and 70 formed on the inner surface of the first wheel 42 and the second wheel 44, respectively, as seen in FIGS. 2, 3 and 5. It should be recognized that alternate means of drivingly engaging wheels, including a friction rubber bearing engaging a smooth or textured inner surface of wheel 42 may alternatively be used.

The sizes of the first wheel 42 and the second wheel 44, and their position relative to the frame 12, are such that both wheels extend in the forward direction beyond the forward end of the frame. As a result, when the cleaner 10 approaches a sidewall or other obstruction while being propelled in the forward direction, one or both of the first wheel 42 and the second wheel 44 will first make contact and cause the cleaner either to turn and proceed in a new direction or else to climb the sidewall or other obstruction.

A third wheel 72 and a fourth wheel 74 of equal size are likewise positioned on opposite sides of the cleaner 10, rearwardly of the suction mast, and rotate on a common axis. However, unlike the first wheel 42 and the second wheel 44, neither the third wheel 72 nor the fourth wheel 74 are driven by the turbine 46. Instead, both the third wheel 72 and the fourth wheel 74 are mounted for freewheeling rotation.

Figure 4:
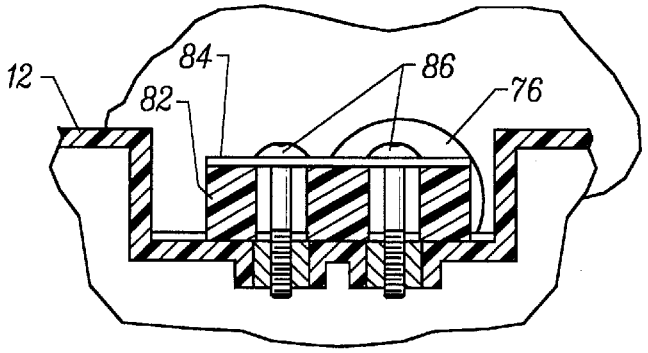
FIG. 4 is an enlarged, fragmentary cross-sectional view taken along the line 4—4 in FIG. 2.

Each of the first wheel 42, the second wheel 44, the third wheel 72 and the fourth wheel 74 is mounted on an axle 76, and each wheel is held in place on the axle by a hub screw 78 and washer 80 (shown in FIG. I), respectively. As partially shown in FIGS. 2 and 4, each axle 76 is integrally molded with a mounting block 82 that is secured in a recess formed in the frame 12 by a mounting plate 84 and screws 86. An elastomeric tire 88 is mounted on each wheel.

Although a detailed plan view of the frame 12 is not illustrated in the drawings, it is contemplated that many openings will be formed in the frame over its lateral and longitudinal extent in order to make it as lightweight as practicable, consistent with maintaining appropriate structural strength. These openings in the frame 12 also serve to prevent air from becoming trapped in the cleaner 10 when it is first submerged in the swimming pool, causing the cleaner to float undesirably. At the same time, however, it is also contemplated that a brass weight (also not shown) will be mounted at the forward end of the frame 12 to increase the traction of the first and second wheels 42 and 44. Of course, the float 34 also has the effect of increasing the traction of the first and second wheels 42 and 44 by virtue of the relatively high elevational positioning of the float 34 at the rear of the cleaner 10. Frame 12, housing 14,16, mast 18 and wheels may be formed of injected molded material.

Referring again to FIGS. 1, 2 and 5, the forward end portion of the upper housing shell 14 includes a sloping portion 90. This sloping portion 90 comprises a substantially flat or linear surface having an angle of about 40 degrees to the horizontal plane of the cleaner 10 and comprises about one-half of the area of the surface of the upper housing shell 14 extending forwardly of the suction mast 18. As the cleaner 10 is propelled in the forward direction, the force of the water in the swimming pool on this sloping portion 90 advantageously tends to push the front of the cleaner in a downward direction. This downward force, in conjunction with the downward force of the aforementioned brass weight and the counterbalancing force applied by the float 34, further increase the traction of the first and second wheels 42 and 44 and reduces the tendency of the front of the cleaner 10 to lift off the submerged surfaces of the swimming pool as the cleaner is propelled in the forward direction.

Figure 7:
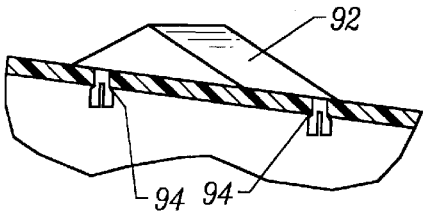
FIG. 7 is an enlarged, fragmentary view, partly in cross-section, of the region indicated by the line 7 in FIG. 5.
Figure 6:
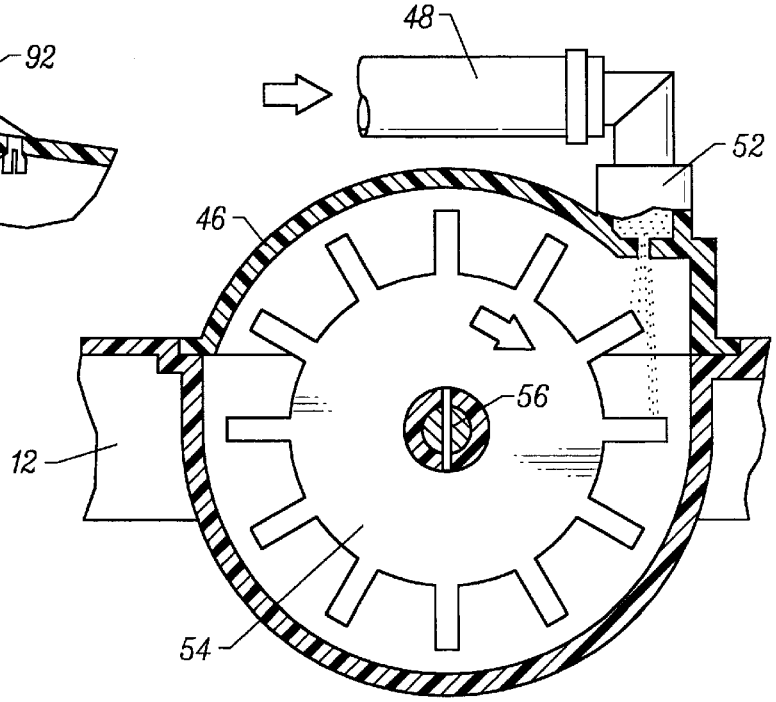
FIG. 6 is an enlarged, fragmentary view, partly in cross-section, of the turbine portion of the automatic swimming pool cleaner shown in FIG. 5.
Figure 8:
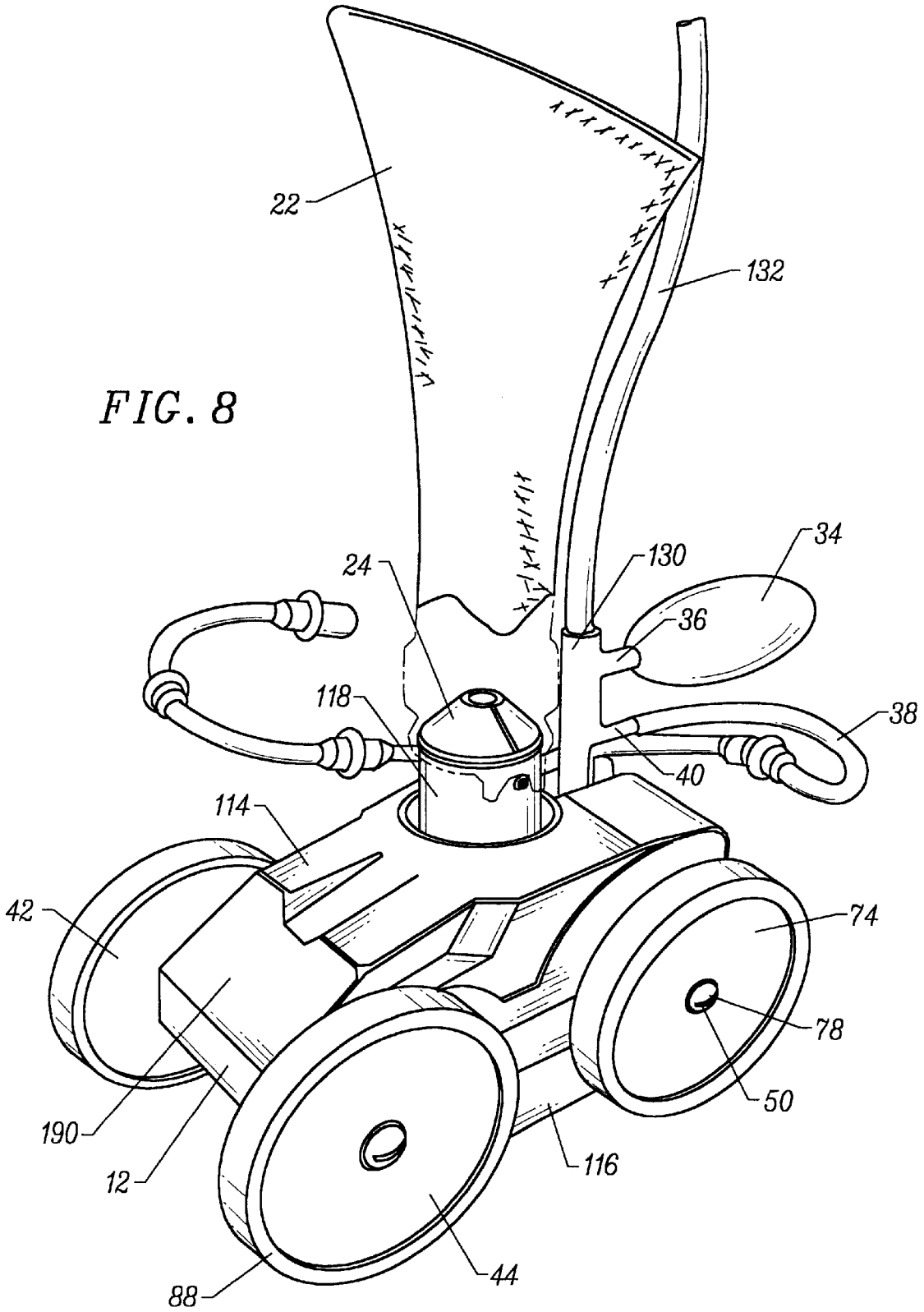
FIG. 8 is a perspective view of a second embodiment of an automatic pool cleaner of the present invention.

For additional traction and reduction of the tendency of the front of the cleaner 10 to lift, a spoiler 92 in the form of a relatively long and narrow V-shaped plate is shown mounted on the upper housing shell 14 forwardly of the suction mast 18. As shown in FIG. 7, for convenience of fabrication, the spoiler 92 can be formed as a separate part and mounted with a snap fit in openings 94 formed in the upper housing shell 14.

FIGS. 8–16 depict a second embodiment of the automatic pool cleaner in accordance with the present invention. In the second embodiment described with respect to FIGS. 8–16, it will be recognized that like reference numerals designate like parts with respect to the embodiment heretofore described with respect to FIGS. 1–7.

In this second embodiment, a booster pump is not required for effective operation of the cleaner. In many applications, it is desirable to utilize automatic cleaners with an existing pool installation where a booster pump is not installed. Normally, the pool cleaning system is fitted with a skimmer which operates a skimmer pump. The skimmer pump may be utilized with the automatic pool cleaner of the present invention to power the cleaner about the pool. In order to accomplish this, the cleaner must be able to operate without placing a strain on the skimmer pump or requiring the skimmer pump to generate additional pressure. To meet this need, the cleaner must be able to pass the same volume of water per unit time which it receives from the pump.

In a first aspect, the diameter of the supply mast has been increased over the first embodiment of the invention. Supply mast 30 in the first embodiment of the present invention has a diameter of approximately one-half inch. In the second embodiment 100 of the present invention, the inner diameter has been increased to approximately 1.0 inches. It should be recognized that the diameter of the supply mast 130 need not be precisely 1.0 inches but may be calculated to be any diameter which is necessary to receive the volume per unit time generated by the particular application for which the cleaner 100 is intended.

Figure 9:
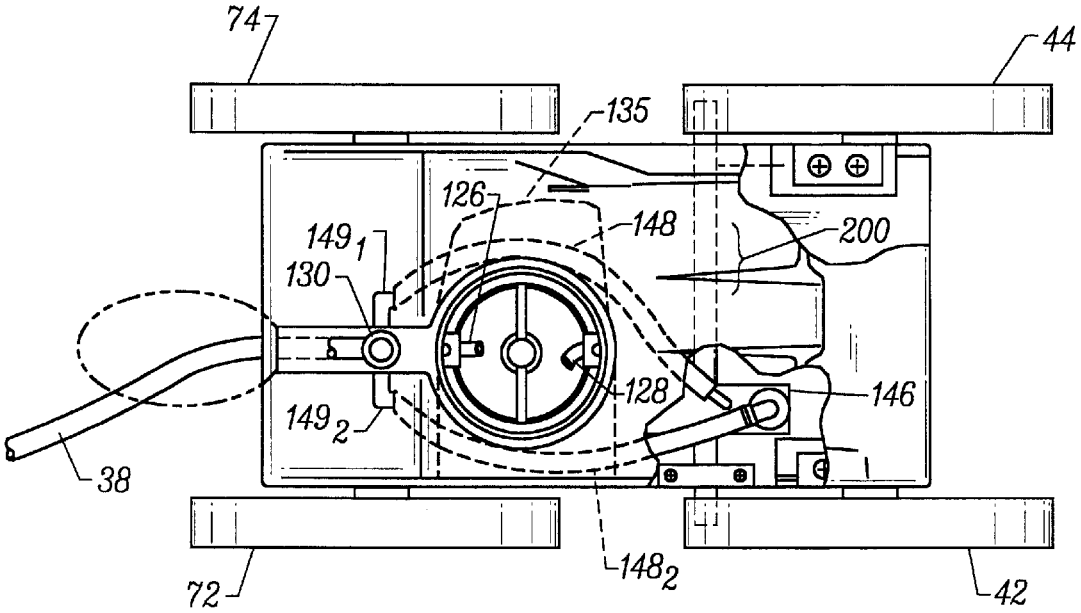
FIG. 9 is a top plan view of the automatic view cleaner shown in FIG. 8, with portions shown in phantom for purposes of illustration, illustrating connection of the supply mast 130 with the turbine 146.

In a second unique aspect of the second embodiment of the present invention, the novel turbine 146 is utilized. In the embodiment shown in FIGS. 9, 10, and 11, the turbine housing 147 includes an upper portion 148 and a lower portion 149. Upper portion 148 includes two water inlet ports $\mathbf{152}_1$, $\mathbf{152}_2$. As shown in FIG. 9, two conduits $\mathbf{148}_1$, $\mathbf{148}_2$ are coupled to outlets $\mathbf{149}_1$ and $\mathbf{149}_2$ on supply mast 130 which transmit the received water from supply line 132 to inlet ports $\mathbf{152}_1$,$\mathbf{152}_2$, respectively. Water inlet port $\mathbf{152}_1$ is oriented so that a water output stream $\mathbf{153}_1$ is approximately 90° in relation to surface 19 of frame 12. Water inlet port $\mathbf{152}_2$ is oriented such that an axis X passing through the center of the inlet port is approximately 60° with respect to the surface 19 of frame 12. Turbine wheel 54 includes a plurality of vanes 55. It will be recognized by one of average skill in the art that the angle of incidence of each of the water streams $\mathbf{153}_1$ and $\mathbf{153}_2$ emanating from water inlet ports $\mathbf{152}_1$and $\mathbf{152}_2$ impact vanes 55 at the same angle of incidence as a particular vane passes through each given stream. The effect of the inlet ports $\mathbf{152}_1$, and $\mathbf{152}_2$ is to increase the volume of water which is received by the turbine which powers the drive shaft 56 and wheels 42,44. Because the water received by supply mast 130 is at lower pressure but greater volume, the greater surface area of multiple vanes 55 must be utilized to maintain the same power for the pool cleaner of the second embodiment operating without a booster pump.

Figure 10:
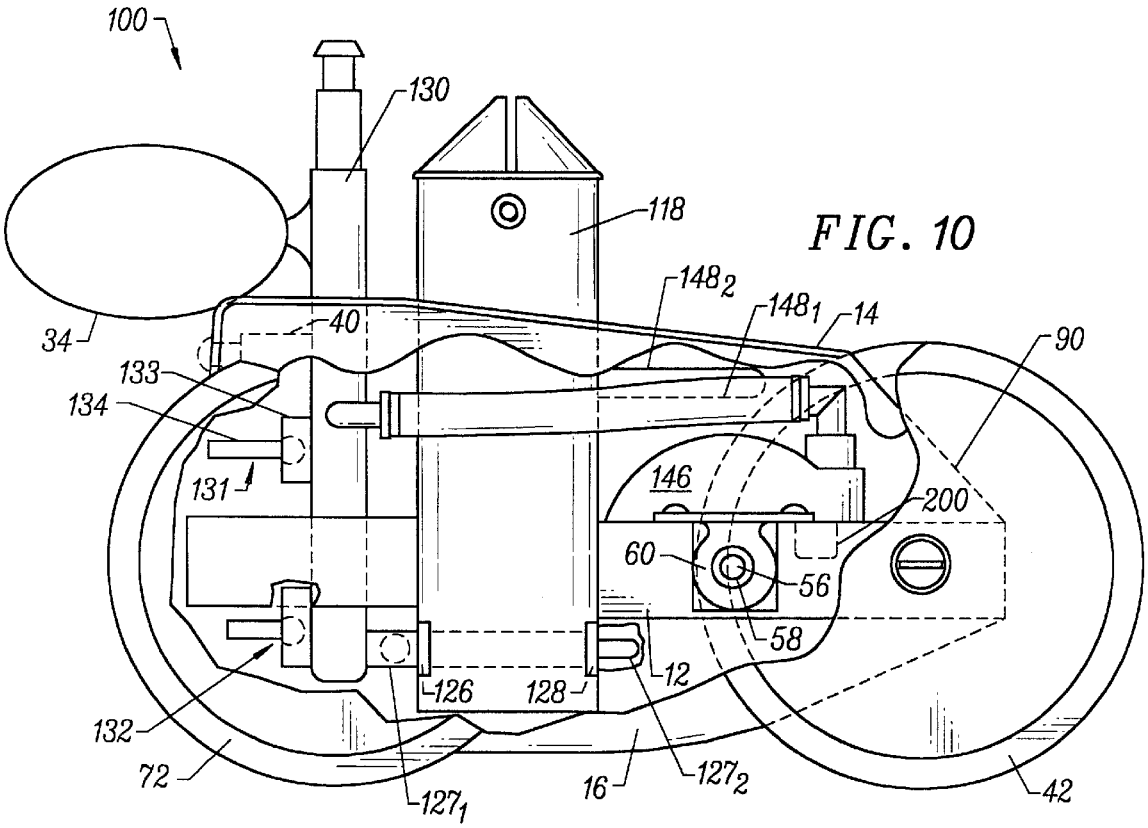
FIG. 10 is an enlarged, fragmentary side view of the cleaner illustrated in FIG. 8.
Figure 11:
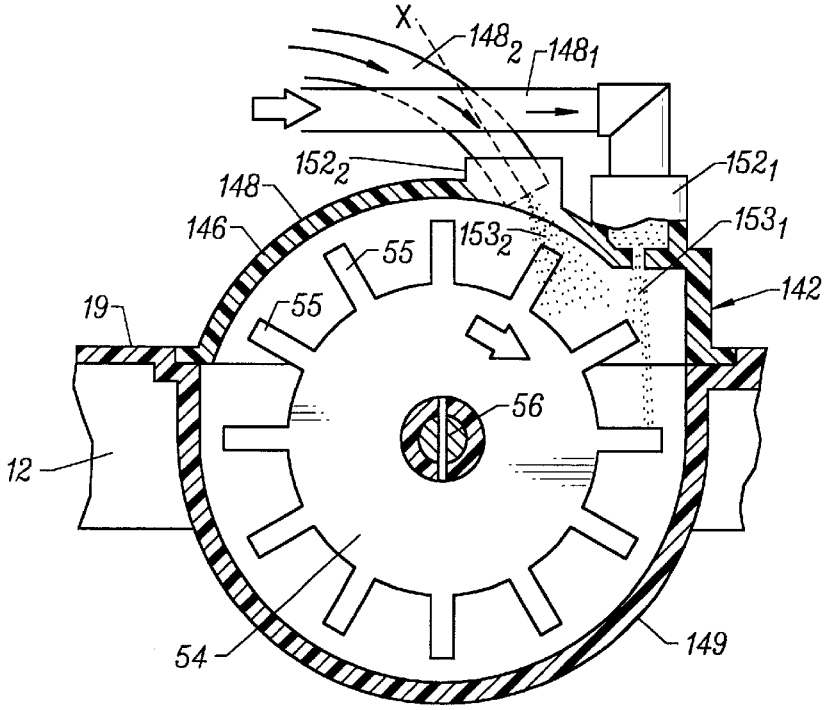
FIG. 11 is an enlarged, fragmentary side view, partly in cross-section, of the turbine portion of the second embodiment of the automatic pool cleaner shown in FIG. 8.

Brass weight 200 (not shown with respect to the first embodiment of the present invention), is illustrated in FIGS. 9 and 10. The approximate weight of the brass weight is approximately 3.0 oz.

FIG. 10 illustrates a third aspect of the second embodiment of the present invention. Two thrust jets 131,132 are illustrated positioned on the supply mast 130. In the first embodiment of the present invention, only thrust jet 132 need be utilized. In a second embodiment of the present invention, thrust jets 131 and 132 are utilized in order to increase the ability of the unit to pass the received water per unit volume into the unit, and also to increase the force which the thrust jets provide relative to the lower pressure which is received in a supply mast 130. Each thrust jet 131,132 comprises a housing 133 and a stem 134 which has, at one end, a ball joint being received in the housing 133 enabling universal rotation of the thrust jets 131,132. This enables the jets to be positioned as desired by the operator of the cleaner for more effective cleaning.

Yet another aspect of the second embodiment of the present invention is illustrated with respect to FIGS. 10 and 12 through 15. As shown therein, at the base of section mast 118, water injection jets 126 and 128 are positioned to transfer water supply via supply mast 130 up into suction mast 118 and generate the vacuum necessary to collect debris off the surface of the pool.

FIG. 13 illustrates the embodiment of the suction jet 26 in the first embodiment of the present invention. As shown therein, each jet, such as jet 26 includes a base portion 26*a* and a stem portion 26*b*. The stem 26*b* includes bore 26*c* which extends the length of the stem 26*b* to an opening 26*d* which is in contact with a transfer conduit, such as conduit 127 shown in FIG. 10, to receive water supplied by supply mast 130.

A second embodiment of the water supply jets is shown in FIGS. 14 through 16. Jet 126 is similar to jet 26 except that jet 126 includes a second opening 126*e* to a second outlet port 126*f* so that water transmitted from supply mast 133 exits the jet in two places, both up toward the collection bag, at the interior of supply mast 130. The second opening increases the amount of water which may pass per unit time into supply mast 130 and maintaining the same suction strength in the second embodiment of the cleaner of the present invention without need for excessive pressure therein.

In a further aspect of the present invention, a back-up valve may be provided on supply line 132. After a predetermined volume of water passes through the supply line 132, the back-up valve diverts the flow of water external to the cleaner, and hence reverses the direction of the suction cleaner 100.

While the position of inlet port $\mathbf{152}_2$ is shown as being adjacent to inlet port $\mathbf{152}_1$, the position of the inlet port may be at any point along the circumference of housing 146 as necessary to complete the incidence of the stream $\mathbf{153}_2$ on the vanes 55. Moreover, multiple inlet ports, greater than two, may be utilized.

Based on the foregoing, it will be appreciated that an improved swimming pool cleaner has been shown and described that has enhanced ability to function in low pressure supply environments. The cleaner has a highly reliable drive train which is substantially encased within the cleaner housing such that the drive train has virtually no exposure to potential jamming or damage from debris. It will further be appreciated that there maybe many configurations for a swimming pool cleaner in which the principles of the present invention are applicable. Therefore, the scope of the present invention should not be seen as limited except by the following claims.

What is claimed is:

1. An automatic pool cleaning apparatus, comprising:

a frame having a forward end and a rear end;

a water inlet mounted on the frame and receiving a supply of water having a volume per unit time;

a plurality of transport wheels mounted on the frame;

a vacuum system including a collection bag positioned on a suction mast having water injection ports positioned such that at least one opening in each water injection port injects water toward the collection bag to create suction and draw debris into the bag; and a drive system including a turbine having a plurality of vanes rotating and mounted in a turbine housing, the housing having a first water input and a second water input each oriented to allow a stream of water passing therethrough to impact an individual vane at the same angle of incidence as the vane passes through the stream, and a drive axle coupled to the turbine and at least one of the plurality of transport wheels.

2. The apparatus of claim 1 wherein each injection port includes a first opening and a second opening, each opening oriented toward the collection bag.

3. The apparatus of claim 1 wherein the first opening is oriented at an angle with respect to the second opening to channel water toward the center of the suction mast.

4. The apparatus of claim 1 further including at least one thrust jet positioned on the water inlet to eject water toward the rear end of the apparatus.

5. The apparatus of claim 4 including at least two thrust jets.

6. The apparatus of claim 1 wherein the first water input and second water input are oriented so that the respective streams of water passing therethrough are oriented approximately 30 degrees apart.

7. The apparatus of claim 1 wherein each injection port includes: a first opening and a second opening, each opening oriented toward the collection bag; at least two thrust jets; and wherein the first water input and second water input are oriented so that the respective streams of water passing therethrough are oriented approximately 30 degrees apart.

8. An automatic pool cleaning apparatus, comprising:

a frame having a forward end and a rear end;

a water inlet mounted on the frame and receiving a supply of water having a volume per unit time;

a plurality of transport wheels mounted on the frame;

a vacuum system including a collection tube, a collection bag coupled to a first end of the collection tube, water injection jets positioned in the tube, each jet coupled to the water inlet and including at least one opening injecting water into the collection opening into the bag; and a drive system including a turbine having a plurality of vanes rotating and mounted in a turbine housing, the housing having a first water input and a second water input each oriented to allow a stream of water passing therethrough to impact an individual vane at the same angle of incidence as the vane passes through the stream, and a drive axle, coupled to the turbine and at least one of the plurality of transport wheels; and at least one thrust port coupled to the water inlet;

wherein a volume of water per unit time passing through the first and second water inputs, the first and second water outlet ports and the water injection ports is generally equal to the volume per unit time at the supply inlet.

9. The apparatus of claim 8 wherein each injection jet includes a first opening and a second opening, each opening oriented toward the collection bag.

10. The apparatus of claim 8 wherein the first opening is oriented at an angle with respect to the second opening to channel water toward the center of the collection tube.

11. The apparatus of claim 8 including at least two thrust jets.

12. The apparatus of claim 8 wherein the first water input and second water input are oriented so that the respective streams of water passing therethrough are oriented approximately 30 degrees apart.

13. The apparatus of claim 8 wherein each injection port includes a first opening and a second opening, each opening oriented toward the collection bag, at least two thrust jets and wherein the first water input and second water input are oriented so that the respective streams of water passing therethrough are oriented approximately 30 degrees apart.

14. A pressurized pool cleaning apparatus, comprising:

a frame having a major surface defining a plane;

a water inlet mast mounted on the frame and receiving a supply of water;

first and second transport wheels mounted on the frame on a first rotational axis on opposing sides at a first end of the frame;

third and fourth transport wheels mounted on the frame on a second rotational axis on opposing sides on a second end of the frame;

a vacuum system including a collection bag coupled to a first end of a collection tube, the vacuum system including a first and second water injection ports positioned in the tube, each port coupled to the water inlet and including a first and second openings injecting water into the collection opening into the bag; and a drive system including a turbine mounted in a turbine housing, the housing having a first water input and a second water input, the first water input oriented at approximately 30 degrees relative to the second input, and a drive axle coupled to said first and second transport wheels.

15. The apparatus of claim 14 wherein the first opening is oriented at an angle with respect to the second opening to channel water toward the center of the suction mast.

16. The apparatus of claim 14 further including at least one thrust jet positioned on the water inlet to eject water toward the rear end of the apparatus.

17. The apparatus of claim 16 including at least two thrust jets.

18. A pressurized pool cleaning apparatus, comprising:

a frame having a major surface defining a plane, the frame having a forward end and a rear end;

a water inlet mast mounted on the frame and receiving a supply of water;

first and second transport wheels mounted on the frame on a first rotational axis on opposing sides at a first end of the frame;

third and fourth transport wheels mounted on the frame on a second rotational axis on opposing sides on a second end of the frame;

a vacuum system including a collection bag coupled to a first end of a collection tube, the vacuum system including a first and second water injection ports positioned in the tube, each port coupled to the water inlet and including a first and second openings injecting water into the collection opening into the bag;

a drive system including a turbine mounted in a turbine housing, the housing having a first water input and a second water input, the first water input oriented at approximately 90 degrees with respect to the plane defined by the frame, and a second input oriented at approximately 60 degrees with respect to said plane, and a drive axle coupled to said first and second transport wheels; and at least one thrust jet positioned on the inlet mast adjacent to the rear end of the frame.

* * * * *